US011879456B2

(12) United States Patent
Nagahara

(10) Patent No.: US 11,879,456 B2
(45) **Date of Patent: *Jan. 23, 2024**

(54) SCROLL COMPRESSOR AND REFRIGERATION APPARATUS INCLUDING SAME

(71) Applicant: DAIKIN INDUSTRIES, LTD., Osaka (JP)

(72) Inventor: Kenji Nagahara, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 76 days.

This patent is subject to a terminal disclaimer.

(21) Appl. No.: 17/523,612

(22) Filed: Nov. 10, 2021

(65) Prior Publication Data

US 2022/0065250 A1 Mar. 3, 2022

Related U.S. Application Data

(63) Continuation of application No. PCT/JP2020/016603, filed on Apr. 15, 2020.

(30) Foreign Application Priority Data

May 21, 2019 (JP) ..... 2019-094994

(51) Int. Cl.
*F04C 18/02* (2006.01)

(52) U.S. Cl.
CPC .... *F04C 18/0215* (2013.01); *F04C 2230/231* (2013.01); *F04C 2230/602* (2013.01); *F04C 2240/30* (2013.01); *F04C 2240/60* (2013.01)

(58) Field of Classification Search
CPC ..... F04C 2/025; F04C 18/0207–0292; F04C 2240/30; F04C 2230/602
See application file for complete search history.

(56) References Cited

U.S. PATENT DOCUMENTS 5,547,355 A 8/1996 Watanabe et al.
2006/0127260 A1 6/2006 Um
(Continued)

FOREIGN PATENT DOCUMENTS

CN 101539142 A 9/2009
CN 101539144 A 9/2009
(Continued)

OTHER PUBLICATIONS

International Preliminary Report of corresponding PCT Application No. PCT/JP2020/016603 dated Dec. 2, 2021.
(Continued)

*Primary Examiner* — Laert Dounis
(74) *Attorney, Agent, or Firm* — Global IP Counselors, LLP

(57) ABSTRACT

A scroll compressor includes a casing, compression mechanism housed in the casing, and drive shaft. The compression mechanism includes fixed and movable scrolls, and a housing. The housing includes a bearing portion configured to rotatably support the drive shaft, a body portion continuous with the bearing portion and extending radially outward, a pressing portion provided radially outside the body portion to press the casing, and a supporting portion extending from a face of the body portion near the fixed scroll. An end face of the supporting portion near the fixed scroll is a fastening face to which the fixed scroll is fastened. A gap is formed between an inner peripheral surface of the casing and outer peripheral surfaces of the body and supporting portions. An axial length of the gap is greater than or equal to an axial length of an inner peripheral surface of the supporting portion.

3 Claims, 5 Drawing Sheets

(56) References Cited

U.S. PATENT DOCUMENTS

| | | | | |
|---|---|---|---|---|
| 2009/0238704 | A1 | 9/2009 | Sakamoto et al. | |
| 2022/0065251 | A1 * | 3/2022 | Nagahara | F04B 39/121 |

FOREIGN PATENT DOCUMENTS

| | | | | | |
|---|---|---|---|---|---|
| EP | 3 239 527 | A1 | | 11/2017 | |
| JP | 7-217554 | A | | 8/1995 | |
| JP | 2009-97417 | A | | 5/2009 | |
| JP | 2009-228440 | A | | 10/2009 | |
| JP | 2010-265845 | A | | 11/2010 | |
| JP | 2014-218934 | A | | 11/2014 | |
| JP | 2014218934 | A | * | 11/2014 | |
| JP | 2017-25762 | A | | 2/2017 | |
| JP | 2017025762 | A | * | 2/2017 | |
| WO | WO-2010113735 | A1 | * | 10/2010 | F04C 23/005 |
| WO | 2016/162912 | A1 | | 10/2016 | |

OTHER PUBLICATIONS

European Search Report of corresponding EP Application No. 20 81 0215.2 dated May 10, 2022.
International Search Report of corresponding PCT Application No. PCT/JP2020/016603 dated Jul. 7, 2020.

* cited by examiner

SCROLL COMPRESSOR AND REFRIGERATION APPARATUS INCLUDING SAME

CROSS-REFERENCE TO RELATED APPLICATIONS

This is a continuation of International Application No. PCT/JP2020/016603 filed on Apr. 15, 2020, which claims priority to Japanese Patent Application No. 2019-094994, filed on May 21, 2019. The entire disclosures of these applications are incorporated by reference herein.

BACKGROUND

Field of Invention

The present disclosure relates to a scroll compressor and a refrigeration apparatus including the same.

Background Information

Scroll compressors including a casing and a compression mechanism having a fixed scroll and a housing have been known (e.g., Japanese Unexamined Patent Publication No. 2017-25762). A housing of a scroll compressor of this document has a pressing portion that is pressed against a casing, and a supporting portion connected to the pressing portion and extending axially. An end face of the supporting portion near a fixed scroll is a fastening face to which the fixed scroll is fastened.

SUMMARY

A first aspect of the present disclosure is directed to a scroll compressor including a casing having a cylindrical shape, a compression mechanism housed in the casing, and a drive shaft configured to rotate the movable scroll. The compression mechanism includes a fixed scroll, a movable scroll, and a housing. The housing includes a bearing portion configured to rotatably support the drive shaft, a body portion continuous with the bearing portion and extending radially outward, a pressing portion provided radially outside the body portion to press the casing, and a supporting portion extending from a face of the body portion near the fixed scroll in an axial direction toward the fixed scroll. An end face of the supporting portion near the fixed scroll is a fastening face to which the fixed scroll is fastened. A gap is formed between an inner peripheral surface of the casing and outer peripheral surfaces of the body portion and the supporting portion. An axial length of the gap is greater than or equal to an axial length of an inner peripheral surface of the supporting portion.

DETAILED DESCRIPTION OF EMBODIMENT(S)

An embodiment will be described. A scroll compressor (1) according to this embodiment is used for a refrigeration apparatus (100). Examples of the refrigeration apparatus (100) include an air conditioner that adjusts the temperature and humidity of air, a cooling apparatus that cools its internal space, and a hot water supply apparatus that produces hot water.

Figure 1:
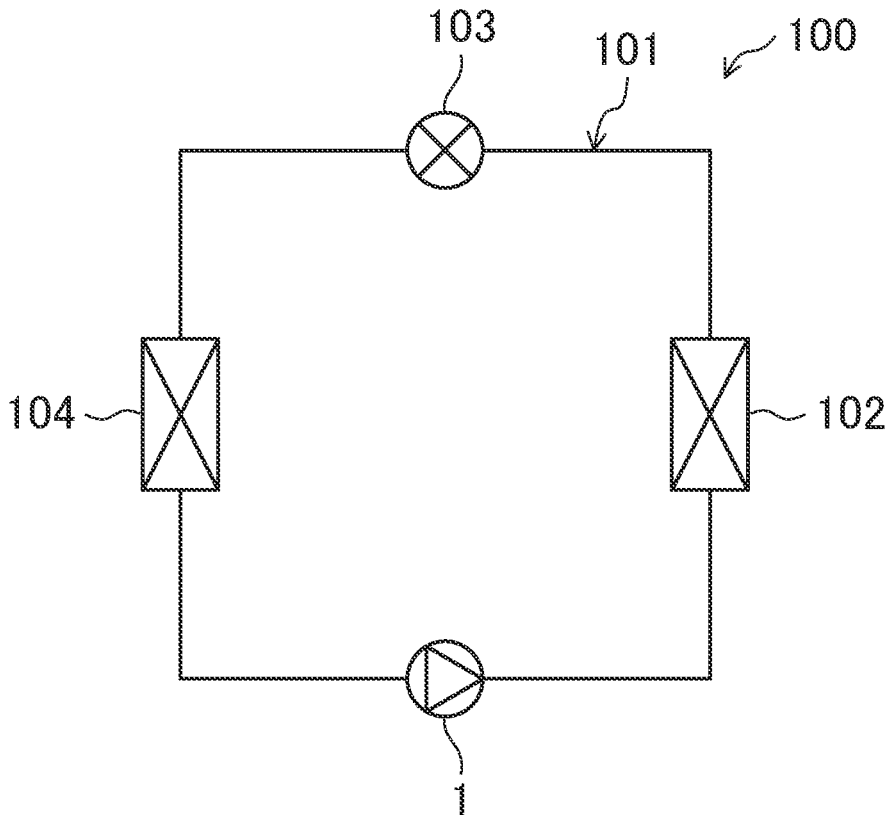
FIG. 1 is a refrigerant circuit diagram showing a schematic configuration of a refrigeration apparatus according to an embodiment.

As shown in FIG. 1, the refrigeration apparatus (100) includes a refrigerant circuit (101) that performs a refrigeration cycle. The refrigerant circuit (101) includes the scroll compressor (1), a condenser (102), an expansion mechanism (103), and an evaporator (104). In the refrigerant circuit (101), a refrigerant compressed by the scroll compressor (1) dissipates heat in the condenser (102) and is decompressed in the expansion mechanism (103). The decompressed refrigerant evaporates in the evaporator (104), and is sucked into the scroll compressor (1).

Figure 2:
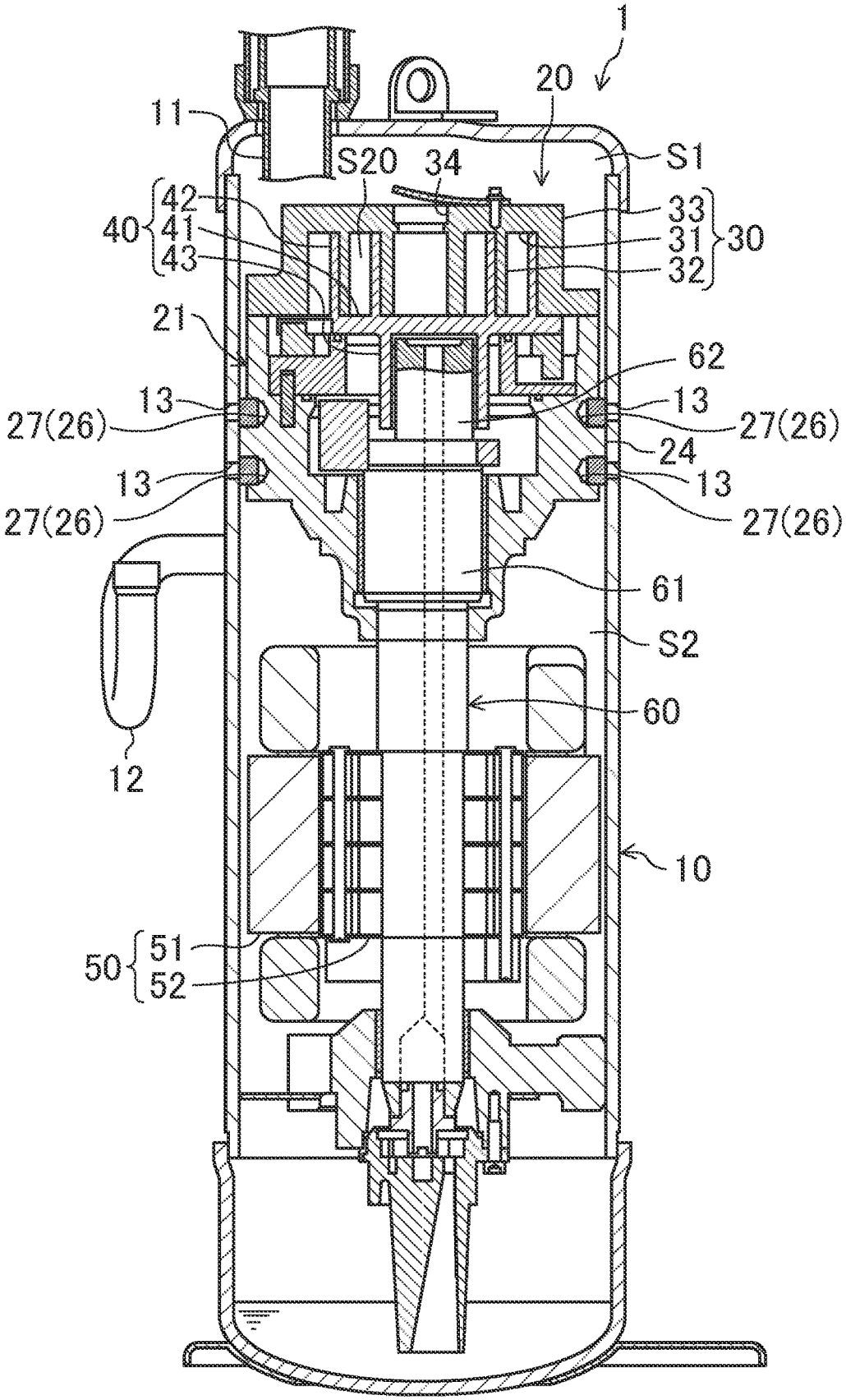
FIG. 2 is a vertical cross-sectional view of a scroll compressor according to the embodiment.
Figure 3:
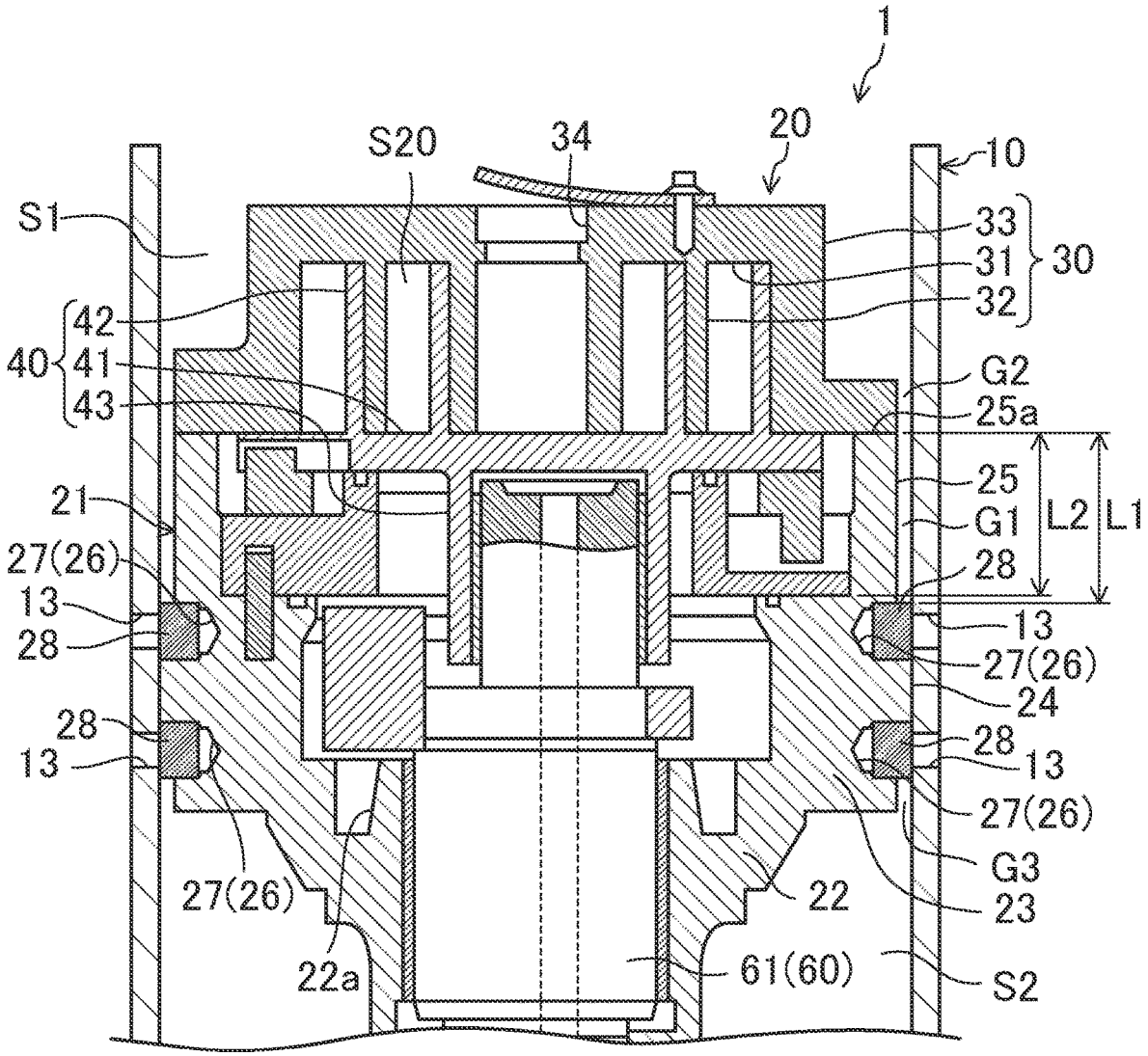
FIG. 3 is a vertical cross-sectional view illustrating an essential portion of the scroll compressor according to the embodiment.

As illustrated in FIGS. 2 and 3, the scroll compressor (1) includes a casing (10), a compression mechanism (20), an electric motor (50), and a drive shaft (60).

The casing (10) is in the shape of a vertically long cylinder with both ends closed. The casing (10) houses therein the compression mechanism (20) and the electric motor (50) sequentially arranged from top. The drive shaft (60) extending in the casing (10) in an axial direction (vertical direction) connects the compression mechanism (20) and the electric motor (50).

The casing (10) is provided with a suction pipe (11) and a discharge pipe (12). The suction pipe (11) passes through an upper portion of the casing (10) in the axial direction so as to be connected to the compression mechanism (20). The suction pipe (11) introduces a low-pressure fluid (for example, a gas refrigerant) into the compression mechanism (20). The discharge pipe (12) passes through the barrel of the casing (10) in a radial direction to communicate with the internal space of the casing (10). The discharge pipe (12) introduces a high-pressure fluid in the casing (10) out of the casing (10).

The compression mechanism (20) is housed in the casing (10). The compression mechanism (20) is configured to compress the fluid introduced through the suction pipe (11) and discharge the compressed fluid into the casing (10). The configuration of the compression mechanism (20) will be described in detail.

The electric motor (50) is housed in the casing (10), and is disposed below the compression mechanism (20). The electric motor (50) includes a stator (51) and a rotor (52). The stator (51) is substantially in the shape of a cylinder, and is fixed to the casing (10). The rotor (52) is inserted in the stator (51) to be rotatable on the inner periphery of the stator (51). The drive shaft (60) is inserted through, and fixed to, the inner circumference of the rotor (52).

The drive shaft (60) has a main shaft portion (61) and an eccentric shaft portion (62). The main shaft portion (61) extends in the axial direction (vertical direction) of the casing (10). The eccentric shaft portion (62) is provided at an upper end of the main shaft portion (61). The outer diameter of the eccentric shaft portion (62) is smaller than that of the main shaft portion (61). The eccentric shaft portion (62) has an axis decentered by a predetermined distance with respect to the axis of the main shaft portion (61).

Next, the configuration of the compression mechanism (20) will be described with reference to FIGS. 2 to 5.

As illustrated in FIGS. 2 and 3, the compression mechanism (20) includes a housing (21), a fixed scroll (30), and a movable scroll (40). The housing (21) is provided in the casing (10). The fixed scroll (30) is fixed to the housing (21). The movable scroll (40) is disposed between the housing (21) and the fixed scroll (30). The movable scroll (40) is configured to mesh with the fixed scroll (30) and rotate eccentrically relative to the fixed scroll (30).

The housing (21) is fixed in the casing (10), and partitions the internal space of the casing (10) into two spaces in the axial direction. One of the spaces above the housing (21) constitutes a first space (S1). The other space below the housing (21) constitutes a second space (S2). The first space (S1) constitutes an internal space.

Figure 4:
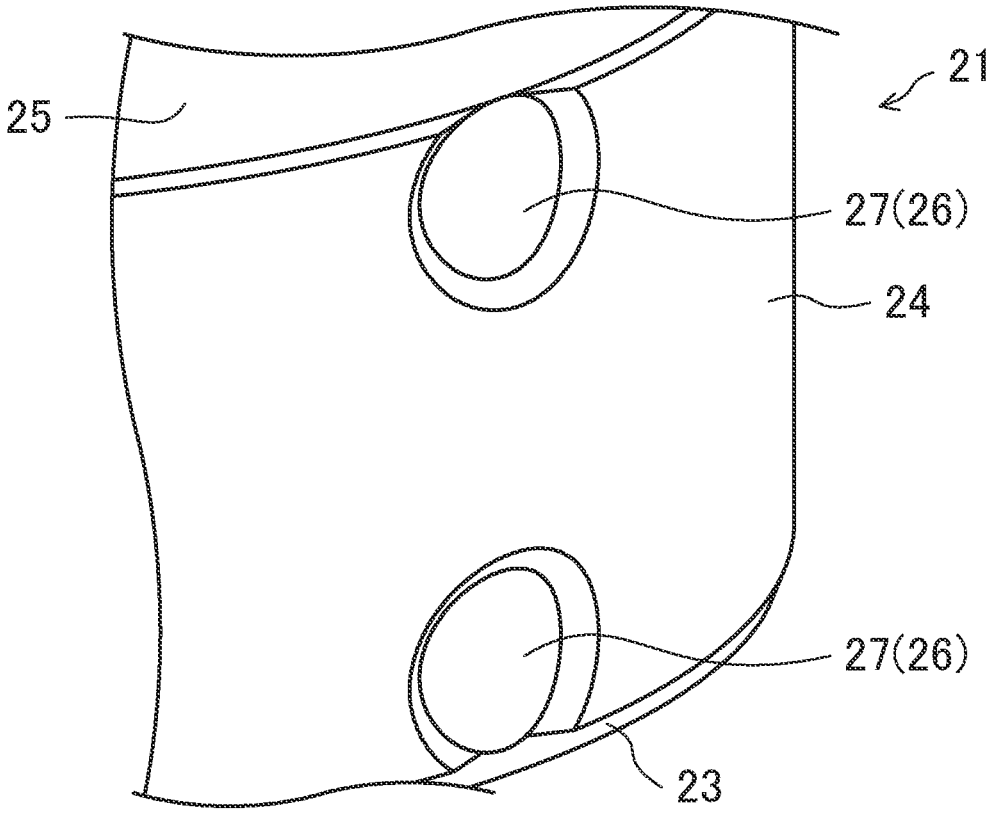
FIG. 4 is a perspective view illustrating an essential portion of a housing according to the embodiment.

The housing (21) is fixed to the inner peripheral surface of the casing (10). As illustrated in FIGS. 3 and 4, the housing (21) includes a bearing portion (22), a body portion (23), a pressing portion (24), a supporting portion (25), and a plurality of weld portions (26).

The bearing portion (22) has a substantially cylindrical shape. The bearing portion (22) rotatably supports the drive shaft (60). An upper face of the bearing portion (22) has an elastic groove (22*a*) that enables elastic deformation of the bearing portion (22).

The body portion (23) is continuous with the bearing portion (22) and extends radially outward. The body portion (23) has a thick cylindrical shape. The radial thickness of the body portion (23) is greater than the radial thickness of the supporting portion (25).

The pressing portion (24) is provided radially outside the body portion (23). The outer peripheral surface of the pressing portion (24) constitutes a portion of the outer peripheral surface of the housing (21). The pressing portion (24) has a smaller axial length (vertical length) than the housing (21). The pressing portion (24) is pressed against and fixed to the barrel of the casing (10).

The supporting portion (25) extends from an upper face of the body portion (23) (in other words, a face of the body portion (23) near the fixed scroll (30) in the axial direction of the casing (10)) toward the fixed scroll (30). The supporting portion (25) has a somewhat thin cylindrical shape. An upper end face of the supporting portion (25) (in other words, an end face of the supporting portion (25) near the fixed scroll (30)) is a fastening face (25*a*) to which the fixed scroll (30) is fastened.

The weld portions (26) are configured as recesses (27) formed on the outer peripheral surface of the housing (21). Welding pins (28) are provided in the recesses (27). The welding pins (28) melt when welded via welding through holes (13) formed in the casing (10), thereby fixing the housing (21) and the casing (10) together.

Figure 5:
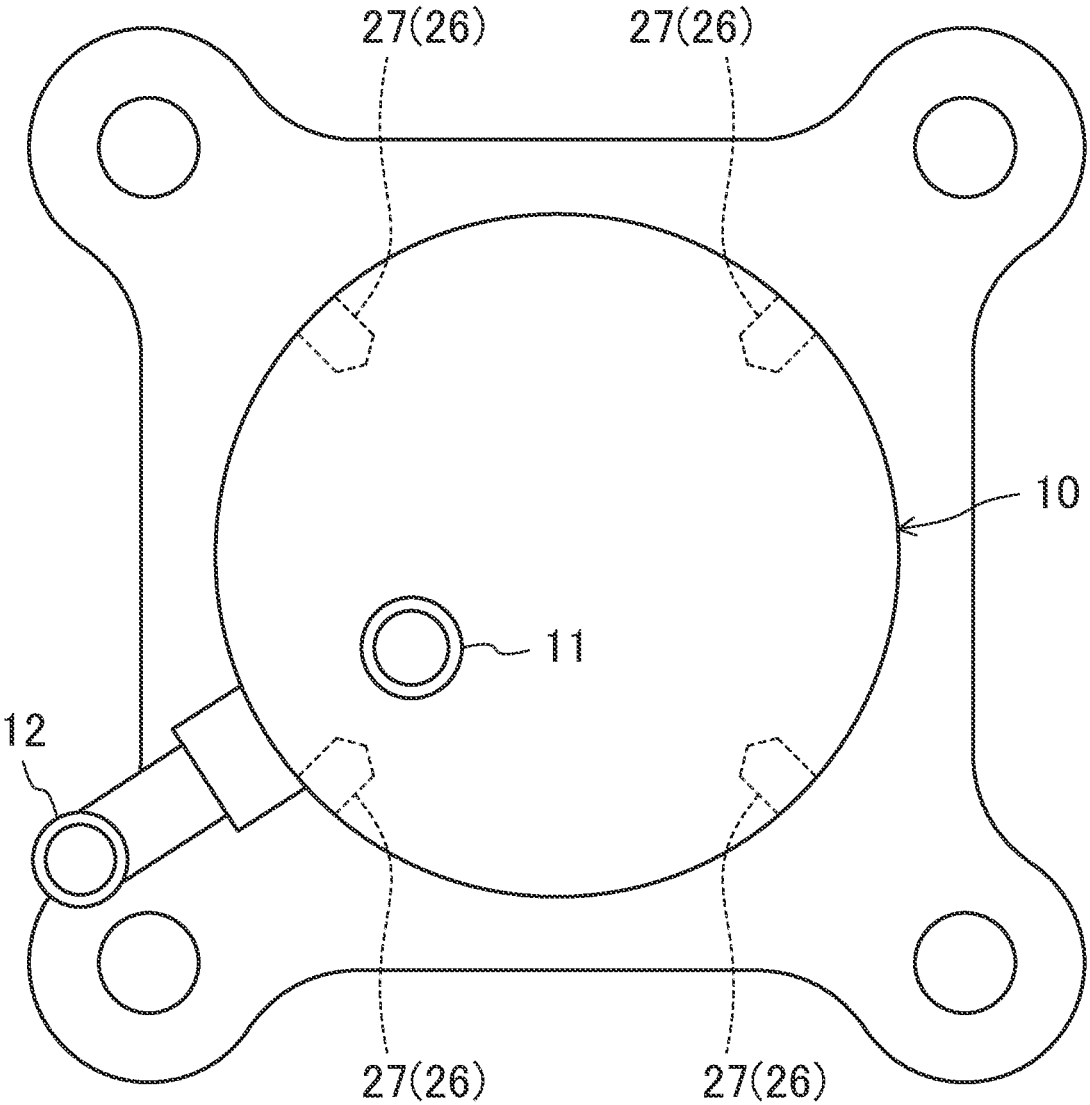
FIG. 5 is a schematic plan view of the scroll compressor according to the embodiment.

Two or more (two in this example) weld portions (26) are arranged in the axial direction of the casing (10) (FIG. 3). Two or more (four in this example) weld portions (26) are arranged in the circumferential direction of the casing (10) (FIG. 5).

A first gap (G1) is formed between the outer peripheral surface of the housing (21) (specifically, the body portion (23) and the supporting portion (25)) and the inner peripheral surface of the casing (10) above the pressing portion (24). A second gap (G2) is formed between the outer peripheral surface of the fixed scroll (30) and the inner peripheral surface of the casing (10). The outer peripheral surface of the fixed scroll (30) is substantially flush with the outer peripheral surface of the supporting portion (25). The first gap (G1) and the second gap (G2) allow the upper ones of the weld portions (26) to communicate with the first space (S1). The first gap (G1) constitutes a gap.

The axial length (L1) of the first gap (G1) is greater than the axial length (L2) of the inner peripheral surface of the supporting portion (25). In other words, the axial distance between the upper end face (fastening face (25*a*)) of the supporting portion (25) and the upper end of the pressing portion (24) is longer than the axial distance between the upper end face of the supporting portion (25) and the upper face of the body portion (23). That is to say, the upper end of the pressing portion (24) is located below the upper face of the body portion (23). Further, the lower end of the pressing portion (24) is located above the lower face of the body portion (23). Thus, the entire pressing portion (24) and the body portion (23) are arranged side by side in the radial direction of the casing (10).

A third gap (G3) is formed between the outer peripheral surface of the housing (21) (specifically, the body portion (23)) and the inner peripheral surface of the casing (10) below the pressing portion (24). The third gap (G3) allows lower ones of the weld portions (26) to communicate with the second space (S2).

As illustrated in FIGS. 3 and 4, at least part of the pressing portion (24) and at least part of the weld portion (26) (the recess (27)) are arranged side by side in the circumferential direction of the casing (10). At least part of the pressing portion (24) and at least part of the weld portion (26) (the recess (27)) are arranged so as to be close to each other in the circumferential direction of the casing (10). At least part of the pressing portion (24) and at least part of the weld portion (26) (the recess (27)) are arranged so as to substantially adjoin each other in the circumferential direction of the casing (10).

At least part of the pressing portion (24) and at least part of the weld portion (26) (the recess (27)) are arranged side by side in the axial direction of the casing (10). At least part of the pressing portion (24) and at least part of the weld portion (26) (the recess (27)) are arranged so as to be close to each other in the axial direction of the casing (10). At least part of the pressing portion (24) and at least part of the weld portion (26) (the recess (27)) are arranged so as to substantially adjoin each other in the axial direction of the casing (10).

Thus, at least part of the pressing portion (24) and at least part of the weld portion (26) (the recess (27)) are arranged side by side in the circumferential and axial directions of the casing (10). At least part of the pressing portion (24) and at least part of the weld portion (26) (the recess (27)) are arranged so as to be close to each other in the circumferential and axial directions of the casing (10). At least part of the pressing portion (24) and at least part of the weld portion (26) (the recess (27)) are arranged so as to substantially adjoin each other in the circumferential and axial directions of the casing (10). Thus, the casing (10) and the housing (21) are more firmly fixed to each other.

The fixed scroll (30) is disposed on one axial side (upper side in this example) of the housing (21). The fixed scroll (30) includes a fixed end plate (31), a fixed wrap (32), and an outer peripheral wall (33).

The fixed end plate (31) has a substantially circular plate shape. The fixed wrap (32) is formed in the shape of a spiral wall that shows an involute curve, and protrudes from a front face (lower face in this example) of the fixed end plate (31).

The outer peripheral wall (33) surrounds the outer periphery of the fixed wrap (32), and protrudes from the front face of the fixed end plate (31). The lower face of the outer peripheral wall (33) is fastened to the fastening face (25*a*) of the supporting portion (25). A distal end face (lower end face in this example) of the fixed wrap (32) is substantially flush with a distal end face of the outer peripheral wall (33).

The outer peripheral wall (33) of the fixed scroll (30) has a suction port (not shown). The suction port is connected to a downstream end of the suction pipe (11). The fixed end plate (31) of the fixed scroll (30) has, at its center, a discharge port (34) penetrating the fixed end plate (31) in a thickness direction.

The movable scroll (40) includes a movable end plate (41), a movable wrap (42), and a boss (43).

The movable end plate (41) has a substantially circular plate shape. The movable wrap (42) is formed in the shape of a spiral wall that shows an involute curve, and protrudes from a front face (upper face in this example) of the movable end plate (41). The boss (43) is formed in a cylindrical shape, and is positioned at a center portion of a back face (lower face in this example) of the movable end plate (41). The movable wrap (42) of the movable scroll (40) meshes with the fixed wrap (32) of the fixed scroll (30).

This configuration provides a compression chamber (S20) between the fixed scroll (30) and the movable scroll (40). The compression chamber (S20) is a space for compressing a fluid. The compression chamber (S20) is configured to compress a fluid sucked from the suction pipe (11) through the suction port, and discharge the compressed fluid through the discharge port (34).

Operation

The scroll compressor (1) according to this embodiment includes: a casing (10) having a cylindrical shape; a compression mechanism (20) housed in the casing (10) and including a fixed scroll (30), a movable scroll (40), and a housing (21); and a drive shaft (60) configured to rotate the movable scroll (40), wherein the housing (21) includes: a bearing portion (22) configured to rotatably support the drive shaft (60); a body portion (23) continuous with the bearing portion (22) and extending radially outward; a pressing portion (24) provided radially outside the body portion (23) to press the casing (10); and a supporting portion (25) extending from a face of the body portion (23) near the fixed scroll (30) in an axial direction toward the fixed scroll (30), an end face of the supporting portion (25) near the fixed scroll (30) is a fastening face (25*a*) to which the fixed scroll (30) is fastened, a gap (G1) is formed between an inner peripheral surface of the casing (10) and outer peripheral surfaces of the body portion (23) and the supporting portion (25), and an axial length (L1) of the gap (G1) is greater than or equal to an axial length (L2) of an inner peripheral surface of the supporting portion (25). Thus, the housing (21) is fixed to the casing (10) by the pressing portion (24). The end face of the supporting portion (25) near the fixed scroll (30) is the fastening face (25*a*) to which the fixed scroll (30) is fastened. The pressing portion (24) and the supporting portion (25) are connected to each other through the body portion (23). Pressure from the casing (10) acts radially on the pressing portion (24). On the other hand, since the gap (G1) is formed between the supporting portion (25) and the casing (10), pressure from the casing (10) does not act directly on the supporting portion (25). However, since the supporting portion (25) is continuous with the pressing portion (24), the position of the supporting portion (25) may vary between before and after the fixing of the housing (21) to the casing (10) due to the pressure acting on the pressing portion (24). A large amount of such variation in the position reduces the sealing performance between the fastening face (25*a*) and the fixed scroll (30). To address this, in this embodiment, the axial length (L1) of the gap (G1) is greater than or equal to the axial length (L2) of the inner peripheral surface of the supporting portion (25). In other words, the axial distance between a face (upper face in this example) of the body portion (23) near the fixed scroll (30) and the fixed scroll (30) is shorter than or equal to the axial distance between an end (upper end in this example) of the pressing portion (24) near the fixed scroll (30) and the fixed scroll (30). Thus, the radial pressure applied from the casing (10) to the pressing portion (24) is securely received by the body portion (23) extending radially. This configuration reduces the variation in the position of the supporting portion (25), and enhances the sealing performance between the fastening face (25*a*) and the fixed scroll (30). It is therefore possible to improve the efficiency of the scroll compressor (1).

The scroll compressor (1) of this embodiment is configured such that the axial length (L1) of the gap (G1) is greater than the axial length (L2) of the inner peripheral surface of the supporting portion (25). This configuration further reduces the variation in the position of the supporting portion (25), and further enhances the sealing performance between the fastening face (25*a*) and the fixed scroll (30). It is therefore possible to further improve the efficiency of the scroll compressor (1).

The scroll compressor (1) of this embodiment is configured such that the radial thickness of the body portion (23) is greater than the radial thickness of the supporting portion (25). Thus, the radial pressure applied from the casing (10) to the pressing portion (24) is securely received by the body portion (23) with a greater radial thickness.

The scroll compressor (1) of this embodiment is configured such that the housing (21) has a weld portion (26) welded to the casing (10), and that at least part of the pressing portion (24) and at least part of the weld portion (26) are arranged side by side in a circumferential direction of the casing (10). This configuration can downsize the housing (21) in the axial direction of the casing (10), and in turn, can downsize the scroll compressor (1), compared to a configuration in which the pressing portion (24) and the weld portion (26) are arranged side by side in the axial direction of the casing (10).

The scroll compressor (1) of this embodiment is configured such that the weld portion (26) communicates with an internal space of the casing (10) through the gap (G1). This configuration allows welding gas to be released into the internal space of the casing (10) through the gap (G1) when the housing (21) is welded to the casing (10), thereby reducing poor welding.

Other Embodiments

The foregoing embodiment may be modified as follows.

For example, the axial length (L1) of the first gap (G1) may be equal to the axial length (L2) of the inner peripheral surface of the supporting portion (25).

Further, for example, the number and arrangement of the weld portions (26) should not be limited to those in the foregoing embodiment, and can be optionally determined.

While embodiments and variations have been described above, it will be understood that various modifications in form and detail may be made without departing from the spirit and scope of the present disclosure as set forth in the appended claims. The foregoing embodiments and variations thereof may be combined and replaced with each other without deteriorating the intended functions of the present disclosure.

As can be seen from the foregoing description, the present disclosure is useful for a scroll compressor and a refrigeration apparatus including the scroll compressor.

The invention claimed is:

1. A scroll compressor comprising:

a casing having a cylindrical shape;

a compression mechanism housed in the casing, the compression mechanism including a fixed scroll, a movable scroll, and a housing; and a drive shaft configured to rotate the movable scroll, the housing including a bearing portion configured to rotatably support the drive shaft;

a body portion continuous with the bearing portion and extending radially outward, a pressing portion provided radially outside the body portion to press the casing, a supporting portion extending from a face of the body portion near the fixed scroll in an axial direction toward the fixed scroll, and a weld portion welded to the casing, an end face of the supporting portion near the fixed scroll being a fastening face to which the fixed scroll is fastened, a gap being formed between an inner peripheral surface of the casing and outer peripheral surfaces of the body portion and the supporting portion, an axial length of the gap being greater than or equal to an axial length of an inner peripheral surface of the supporting portion, at least part of the pressing portion and at least part of the weld portion being arranged side by side in a circumferential direction of the casing, and the weld portion communicating with an internal space of the casing through the gap.

2. The scroll compressor of claim 1, wherein the axial length of the gap is greater than the axial length of the inner peripheral surface of the supporting portion.

3. A refrigeration apparatus including the scroll compressor of claim 1.

* * * * *